United States Patent [19]

Lawrence

[11] Patent Number: 4,850,071

[45] Date of Patent: Jul. 25, 1989

[54] CLEANING TOOL WITH MANUAL AND POWER ADAPTION

[76] Inventor: Thomas L. Lawrence, Box 145, Buffalo, Wyo. 82834

[21] Appl. No.: 172,238

[22] Filed: Mar. 23, 1988

[51] Int. Cl.[4] ..... B08B 9/02

[52] U.S. Cl. ..... 15/104.1 R; 15/104.2; 15/23; 15/26; 15/200; 15/206

[58] Field of Search ..... 15/104.1 R, 104.2, 23, 15/25, 26, 104.3 R, 104.09, 106, 198, 200, 179

[56] References Cited

U.S. PATENT DOCUMENTS 1,684,631 9/1928 Lapinoja ..... 15/206
2,510,376 6/1950 Burch ..... 15/104.2 X
3,118,162 1/1964 Karr et al. ..... 15/104.1 X
3,293,680 12/1966 Wilson et al. ..... 15/104.1 R

FOREIGN PATENT DOCUMENTS 544870 4/1942 United Kingdom ..... 15/206

*Primary Examiner*—Peter Feldman
*Attorney, Agent, or Firm*—John S. Hale

[57] ABSTRACT

A tool cleaner for selected manual or powered use comprising a stem assembly with a brush mounted on one end of the stem assembly and a handle mounted to the other end of the stem assembly. The stem assembly includes a stem portion with a hexagonal member mounted on the stem portion. The hexagonal member is positioned between the brush and the handle. A second hexagonal member is mounted on the handle and is axially aligned with the first hexagonal member.

14 Claims, 1 Drawing Sheet

CLEANING TOOL WITH MANUAL AND POWER ADAPTION

DISCLOSURE OF THE PRIOR ART

Copper and brass pipe fittings must be cleaned before they are assembled to copper pipe or copper fittings for soldering. This cleaning is normally accomplished with a fitting wire brush of a cylindrical shape which is turned by hand in a fitting held in the other hand. In certain instances, plumbers have to clean in excess of 100 fittings in a day which is a very tiring and time consuming task.

Various types of powered devices have been developed for cleaning pipes and tubes in the prior art. In U.S. Pat. No. 430,767, a gun cleaning brush is shown using a twisted rod and plug having an opening shaped to fit the rod. When the plug with the rod is inserted into the end of the gun barrel, force is applied to the handle, and the rod with its scrapper is forced inward at the same time rotating throughout its travel through the barrel. U.S. Pat. No. 3,604,040 discloses a brush mounted on a twisted wire shaft which is adapted to fit into a chuck having a cylindrical bore to receive the shaft. A tapered set screw is threaded through the wall of the chuck to engage the spiral grooves formed by the twisted wire and hold the shaft within the chuck so that the brush is rotated when the chuck is rotated by a powered driving tool. U.S. Pat. No. 2,158,577 discloses a sewer cleaning tool with a flexible shaft in which a coupling is used for securing the flexible driving shaft to another tool. As is shown in FIG. 6, a drill or other power tool can be connected to the flexible shaft by way of the hexagonal chuck coupling shown. U.S. Pat. No. 4,674,218 discloses a gun bore cleaning device using threaded wiper pieces.

U.S. Pat. No. 2,728,927 discloses a cleaning and abrading tool in which short links of wire are placed between rods of a helix by continuously and uniformly inserting the ends of the wire into the spaces between the rods. As the spaces gradually become closed during the twisting operation the middle portions of the wires are rigidly anchored. The ends of the wires are then uniformly cut along the lower portion of the helix to form a lower helical brush portion and an upper brush. The disclosure indicates that it is possible to shape the upper end of the helix to form a handle or if a handle is not formed, the operation of the cleaning can be accomplished by mounting the helix in the chuck of an electrical drill. U.S. Pat. No. 619,906 discloses a twisted stem and brush. The stem is mounted in a handle of the apparatus for reciprocation and rotation.

While the aforementioned patents disclose various methods and apparatus known in the prior art which are used to attempt to solve the problem, a need exists for a combination apparatus which allows the user to either use the pipe cleaning tool manually for certain jobs or easily convert the cleaning tool to a modification which will fit into a power tool.

SUMMARY OF THE INVENTION

The present invention is directed to a simple, economically constructed, sturdy cleaning tool for pipes or other items which can be selectively used in a manual mode or with a power tool depending upon the need of the user.

The cleaning tool in the powered mode can either be inserted directly into a power tool through the handle shaft or severed below the stem hexagonal shaft portion for insertion into a power tool. The invention is adapted for use in any variable speed electric drill or screwdriver having a control that limits the speed of the chuck between 100 and 150 rpm. The present cleaning tool can clean multiple pipe fittings in a very short time with no more effort than it takes to hold a screw driver. Thus, copper fittings can be cleaned in about half the time that they were manually able to be cleaned and when used in the powder mode, torque is supplied uniformly along the brush by virtue of the uniform hexagonal connector.

Other objects, features and advantages of the invention will become apparent in the following description thereof, taken in conjunction with the accompanying drawings which form part of the specification.

DETAILED DESCRIPTION OF THE INVENTION

Figure 1:
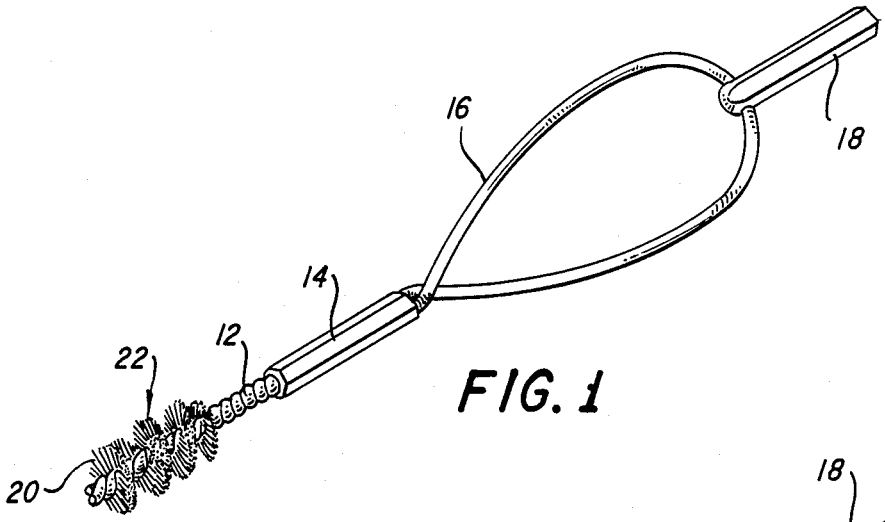
FIG. 1 is a perspective view of the inventive cleaner tool apparatus.
Figure 2:
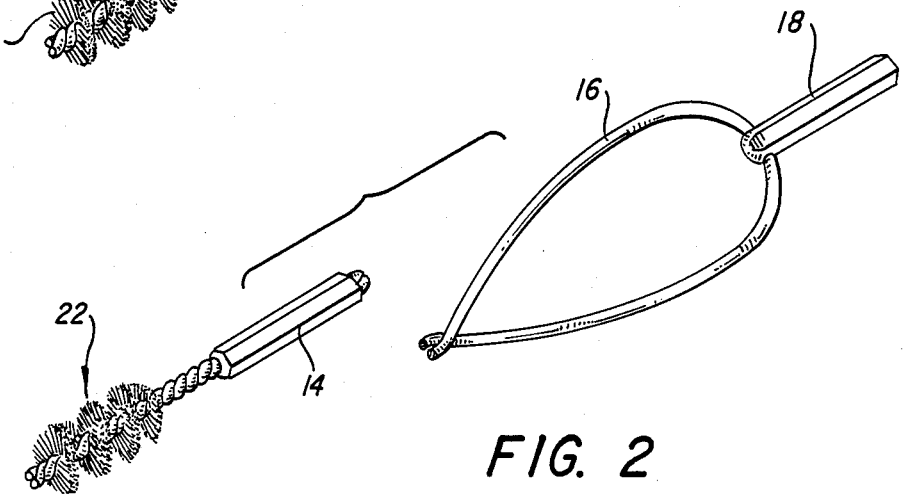
FIG. 2 is a exploded view of the cleaner tool shown in FIG. 1 with the stem severed.
Figure 3:
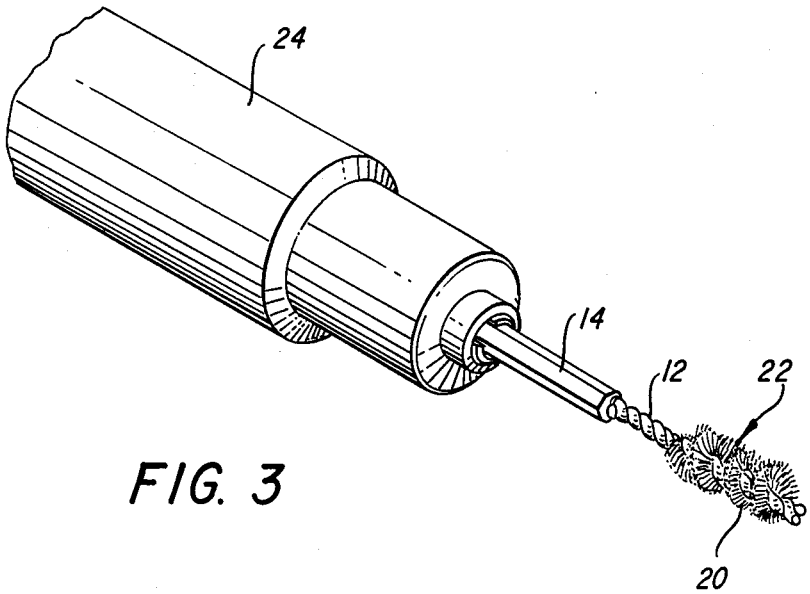
FIG. 3 is a perspective view of the severed stem portion shown in FIG. 2 inserted into an electrically powered screw driver.

The preferred embodiment and best mode of the invention is shown in FIGS. 1 through 3 and comprises a cleaner tool apparatus 10. The cleaner tool apparatus 10 comprises a twisted wire stem or shaft portion 12 secured to a hexagonal shaft portion 14 which is in turn secured to a twisted wire handle 16. Alternatively, the hexagonal shaft portion may be in the form of a hollow hexagonal member with the wire stem inserted through the hollow member and secured to the member. The twisted wire stem can alternatively be a single rod which is inserted through the hollow hexagonal member and secured in the same manner or the hexagonal shafts can be made of the same wire by grinding or forming hexagonal shaped portions from the wire. Furthermore, if desired, the brush can be of unitary construction and threaded onto the end of the rod. The rear of handle 16 has a second hexagonal shaft 18 securely mounted thereto and the twisted wire stem portion 12 has on its proximal end a plurality of metallic bristles 20 which form a wire circular brush 22.

The hexagonal shaft portion 14 is approximately 1 inch in length ranging in size from ¼ inch to ½ inch depending on the size of the brush and the size of the fitting to be cleaned. The preferred size which is utilized is that of a ¼ inch shaft. The second hexagonal shaft 18 positioned on the handle 16 is also approximately 1 inch in length with the same size hexagonal construction as shaft portion 14. This second hexagonal shaft 18 is axially aligned with hexagonal shaft portion 14. Alternatively, the second hexagonal shaft 18 can be of a different sized hexagonal construction than shaft portion 14 allowing the tool to be used with different sized power tools.

Thus, the cleaner tool apparatus can be used manually by simply twisting the handle 16 to rotate the brush 22 in the fitting, or alternatively be a power driven tool by the handle shaft 18 being inserted into any common electric screw driver 24 which accepts hexagonal tools. Alternatively, the main shaft of the brush could be cut off below the upper hexagonal shaft as is clearly shown in FIG. 2 for insertion into any common electric screwdriver which accepts ¼ inch hexagonal shafted tools. Most electric screwdrivers have an operable rpm of 120 to 130 which is the most desirable speed to use the present invention. With the handle and main shaft cut off as illustrated in drawings 2 and 3, the brush may be used in any variable speed electric drill having controls that limits the speed of the drill between 100 and 150 rpms. Speeds faster than 150 rpm make the fitting hard to hold and can cause injury to the operator's fingers. Faster speeds or fittings larger than 1 inch can still be cleaned holding the fitting in a vice or clamp and using both hands to hold the drill or screwdriver.

Thus, it can be seen that both hexagonal shaft portions 14 and 18 can be of the same size or of different sizes as for example ¼ inch for the first hexagonal portion and ⅜ inch or ½ inch for the second hexagonal portion so that the tool can universally be used in all common electric drills or screwdrivers on the market while still keeping the manual option.

In the foregoing description, the invention has been described with reference to a particular preferred embodiment, although it is to be understood that specific details shown are merely illustrative, and the invention may be carried out in other ways without departing from the true spirit and scope of the following claims:

What is claimed:

1. A cleaner tool apparatus for selected manual or powered use in combination with a power tool comprising a stem means, brush means mounted on one end of said stem means and handle means secured to the other end of said stem means, a hexagonally shaped member secured to said stem means and positioned between said brush and said handle means to provide transmission of torque from a power tool to said brush means during a powered mode.

2. A cleaner tool apparatus assembly as claimed in claim 1 wherein said brush means is a cylindrically shaped wire brush.

3. A cleaner tool apparatus as claimed in claim 1 wherein said hexagonally shaped member is solid with a throughgoing bore.

4. A cleaner tool apparatus as claimed in claim 3 wherein said hexagonally shaped member has six flat sides running along its length and the distance between opposing flat sides is ¼ inch.

5. A cleaner tool apparatus as claimed in claim 3 wherein said hexagonally shaped member has six flat sides running along its length and the distance between opposing flat sides is ½ inch.

6. A pipe cleaning apparatus comprising stem means, said stem means including a twisted wire portion and hexagonally shaped portion secured at one end to said twisted wire portion, a cylindrically shaped wire brush secured to said twisted wire portion of said stem means positioned away from said hexagonally shaped portion and handle means comprising a wire loop secured to said hexagonally shaped portion.

7. A cleaner apparatus as claimed in claim 6 wherein a second hexagonally shaped shaft member is secured to said handle means.

8. A cleaner apparatus as claimed in claim 7 wherein said second hexagonally shaped shaft member is axially aligned with the stem hexagonally shaped portion.

9. A pipe cleaner apparatus for selected manual or powered use comprising stem means, said stem means including a first portion of a specific diameter and a shaft portion with an angular cross section of a greater diameter secured to said first portion, a brush secured to said first angular shaft portion of said stem means, handle means secured to said angular shaft portion, a shaft member with an angular cross section secured to said handle means, said angular shaft member being in axial alignment with said angular shaft portion.

10. A pipe cleaning apparatus as claimed in claim 9 wherein said angular shaft portion and said angular shaft member are hexagonal in cross section said angular shaft portion and said shaft member being different sizes ranging from ¼ to ½ inch.

11. A pipe cleaning apparatus as claimed in claim 9 wherein said hexagonal stem portion and said hexagonal shaft member are of the same size.

12. A pipe cleaning apparatus as claimed in claim 11 wherein said hexagonal stem portion and shaft member are ¼ inch.

13. A pipe cleaning apparatus as claimed in claim 9 wherein said wire brush is removably secured to said first stem portion.

14. A pipe cleaning apparatus comprising stem means, said stem means including a wire portion and a hexagonally shaped member secured to said wire portion, a cylindrically shaped wire brush secured to said wire portion of said stem means positioned away from said hexagonally shaped shaft, handle means secured to said wire portion and a second hexagonal shaped shaft secured to said handle means.

* * * * *